US005226836A

United States Patent [19]

Rosenberg

[11] Patent Number: 5,226,836

[45] Date of Patent: Jul. 13, 1993

[54] CABLE STRAIN RELIEF DEVICE

[75] Inventor: Jeffrey S. Rosenberg, Tulsa, Okla.

[73] Assignee: TDW Delaware, Inc., Wilmington, Del.

[21] Appl. No.: 906,547

[22] Filed: Jun. 30, 1992

[51] Int. Cl.[5] ..... H01R 13/58

[52] U.S. Cl. ..... 439/451; 439/373; 439/449; 439/473; 248/224.3; 24/129 A

[58] Field of Search ..... 439/449, 451, 362, 473, 439/373; 248/224.3; 24/129 A

[56] References Cited

U.S. PATENT DOCUMENTS 1,979,756 11/1934 McNamee et al. ..... 439/451

3,811,104 5/1974 Caldwell ..... 439/362

4,424,407 1/1984 Barbic ..... 174/67

4,662,697 5/1987 Moses ..... 439/373

4,702,709 10/1987 Santilli ..... 439/373

*Primary Examiner*—Gary F. Paumen

*Attorney, Agent, or Firm*—Head & Johnson

[57] ABSTRACT

A strain relief device for a cable terminating in a plug, an outlet mounted on a base and a connection mechanism to connect said plug to said outlet. The device includes at least one pin extending from the plug, the pin being spaced from the connection mechanism. A block having a receptacle for receipt of the pin is mounted on the base, so that force exerted from the cable is dissipated by the device.

4 Claims, 2 Drawing Sheets

CABLE STRAIN RELIEF DEVICE

BACKGROUND OF THE INVENTION

1. Field of the Invention

The present invention pertains to a device to assist in dissipating the force exerted by strain on a cable. In particular, the present invention pertains to a plug adapter for a cable which is combined with a strain relief device to assist in dissipating the force from strain on a cable.

2. Prior Art.

A cable that is strung between two points is subject to a certain amount of strain which is the force exerted by the distortion on the original dimension. Where one end of a cable terminates in a plug which is connected to an outlet, the force on the cable may be directed to the plug and the connection with the outlet.

If this force is extreme, the plug, the connection or the outlet may be subject to failure.

Accordingly, it is desirable to relieve the force from the strain on the cable.

While there are various devices that connect to the cable itself prior to the connection between the plug and the outlet (such as Barbic, U.S. Pat. No. 4,424,407), nothing in the prior art suggests a device to relieve the strain force exerted from the cable which is a part of the plug itself.

Likewise, there are various devices and installations which may be attached to a cable in an effort to counteract the force from the cable. Nevertheless, these devices are typically separate devices or mechanisms not associated with the plug or connection between the plug and the outlet. Additionally, these devices will not be attached or detached along with the connection mechanism of the plug and outlet.

Accordingly, it is a principal object and purpose of the present invention to provide a device associated with the plug and the connection between the plug and the outlet which will dissipate the force exerted from strain on a cable.

It is a further object and purpose of the present invention to provide a strain relief device which may be installed or removed without tools or additional parts.

SUMMARY OF THE INVENTION

The present invention provides a strain relief device for use with a cable such as flexible conduit for supporting a internal wire or wires. The cable would terminate at one end in a plug. The plug being connected with an outlet on a base.

A detachable connection mechanism will connect the plug to the outlet. In one embodiment, a male portion is located on the plug with the female portion on the outlet.

The plug includes an adaptor section which is substantially perpendicular to the connection mechanism. Extending from an end of the adaptor is the cable.

Affixed to the base is a block which may be secured to the base. The block contains a pair of receptacles. The receptacles are parallel to each other and are substantially cylindrical recesses beginning at the surface of the block and extending into the block.

The adaptor section of the plug has a pair of extending pins which extend outward from the adaptor section. The pins are substantially cylindrical posts having rounded ends. The pins may be received in the receptacles.

When the male portion is connected to the female portion of the connection mechanism, the extending pins will be received within the receptacles at the same time. Accordingly, a single, simple operation is performed to install the strain relief device and connect the cable for its intended purpose.

The pins as well as the receptacles serve the function of absorbing or dissipating forces exerted from the cable. The pins fit relatively snugly within the receptacles. Accordingly, any force exerted on the cable will not be transmitted to the connection mechanism, plug or outlet.

DETAILED DESCRIPTION OF THE PREFERRED EMBODIMENTS

Figure 1:
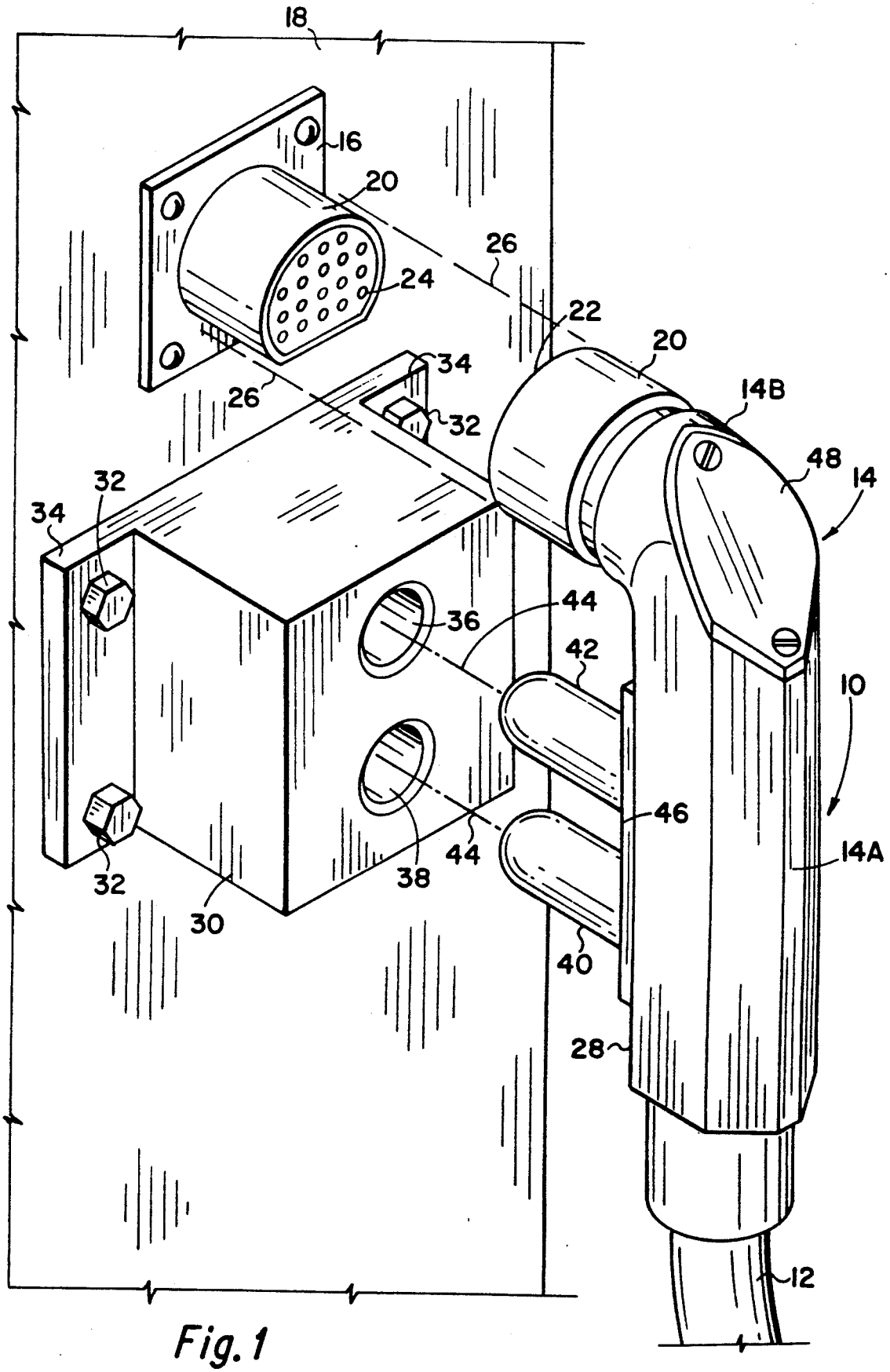
FIG. 1 shows a perspective view of a strain relief device in detached position.

Referring to the drawings in detail, FIG. 1 illustrates a perspective view of a strain relief device 10 constructed in accordance with the present invention.

The device is for use with a cable 12, a certain portion of which is visible in FIG. 1. It will be appreciated that the device will be used for various applications. The device has applications for various cables such as flexible conduit for supporting an internal wire or wires (not seen in FIG. 1). The device 10 may also be used for hydraulic or pneumatic tubes. The device has particular advantages where long heavy cables are involved.

The cable 12 terminates at one end in a connector housing 14. The connector housing 14 will connect with an outlet or bulk head 16 on a base 18. Connector housing 14 has an elongated 14A and an integral perpendicular portion 14B.

The connector housing 14 will connect with the outlet through a detachable connection mechanism 20. In the present embodiment, a male portion 22 (See FIG. 2) is located on the housing side with the female portion 24 on the outlet side. It will be understood, however, that these may be reversed in orientation. The male portion and the female portion may be connected together by a snap fit, by a friction fit, by threads on the respective sides for a screw fit, or otherwise. In each of these cases, the internal wire or wires will make contact with corresponding internal wires (not shown) connecting to the outlet.

In FIG. 1, the connector housing is shown detached with the dashed lines 26 illustrating how connection is accomplished.

The connector housing 14 includes an adaptor section 28 which is substantially perpendicular to the connection mechanism 20. Extending from an end of the adaptor section is the cable 12.

A portion of the base or bulk head 18 is visible in FIG. 1.

Affixed to the base 18 is a block 30. The block 30 may be secured to the base in any known fashion such as with screws 32 passing through a flange or flanges 34 of the block. Ideally, the block will be constructed of a sturdy material to withstand forces thereon.

The block 30 contains a pair of receptacle openings 36 and 38. The receptacle openings 36 and 38 are parallel to each other and are substantially cylindrical recesses starting from the surface of the block and extending into the block.

The connector housing elongated portion 14A has a pair of perpendicularly extending pins 40 and 42. The pins 40 and 42 are substantially cylindrical posts having rounded ends. The pins will be constructed of a sturdy material to withstand forces thereon. The pins 40 and 42 may be received in the receptacle openings 36 and 38 as indicated by the dashed lines 44.

The extended pins 40 and 42 may be formed as a part of connector housing 14. Alternatively, as seen in the embodiment of FIG. 1, the pins 40 and 42 extend from a plate 46 which is secured to the connector housing.

The connector housing also may include an access plate 48, so that entry may be gained into the interior of housing and to the connector mechanism 20 for servicing and repair.

When the male portion 22 is connected to the female portion 24 of the connection mechanism, the extending pins 40 and 42 will, at the same time, be received within the receptacle openings 36 and 38. Accordingly, a single, simple operation is performed to install the strain relief device 10 and connect the cable for its intended purpose.

It will be appreciated that the pins 40 and 42 as well as the receptacle openings 36 and 38 do not conduct electricity but serve a mechanical function of absorbing or dissipating forces that are exerted on the cable so as to prevent those forces from acting on the connection mechanism.

While it will be recognized that in the present embodiment, the pins 40 and 42 extend from the connector housing and are received in receptacle openings mounted on the base, the pins and receptacle openings may be reversed in orientation. In that case, the pins would extend from the base 18 and be received in receptacle openings mounted on the connector housing.

The cable 12 is subject to forces from a number of factors. In many instances, temperature and humidity changes will expand or contract the cable. Long, heavy cables will exert forces by the weight of the cables. Wind and other environmental factors may place strain on the cable. In some instances, the cable may be designed to be relatively elastic and stretching and contracting will occur. In each of these instances, a force from the cable 12 will be exerted on the connector housing 14. Without a way to dissipate or relieve this force, the force would be transferred to the outlet 16.

Figure 2:
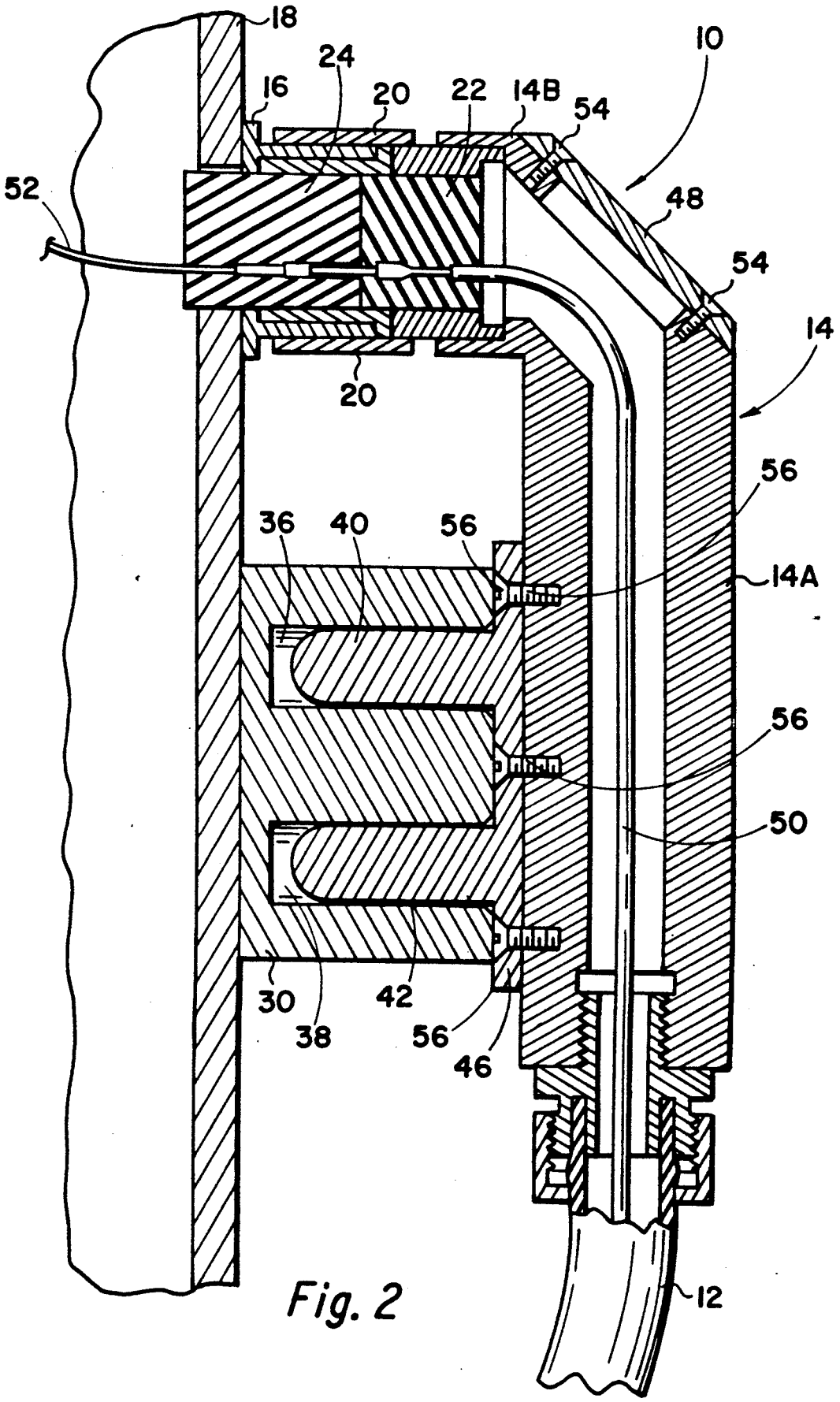
FIG. 2 is a sectional view of the cable strain relief device shown in FIG. 1 in connected position.

FIG. 2 shows a sectional view of the strain relief device 10 which has been connected with the outlet 16.

The cable 12 contains an internal electrical line or wire 50 which passes therethrough and is visible in FIG. 2. The wire 50 continues through the connector housing elongated portion 14A up to the male portion 22 where it makes contact with a corresponding wire 52 in to the female portion 24.

The access plate 48 may be retained in place by screws, 54 or other fasteners so that entry may be made into the connector housing in the event of repair or maintenance.

The plate 46 from which extends the pins 40 and 42 may be secured to the connector housing by a series of screws 56, passing through apertures in the plate 46.

The forces exerted from the cable are primarily perpendicular to the axis of the pins. Torsional forces exerted from movement or placement of the cable 12 would also be alleviated by the pins in the receptacle openings.

As will be observed from the sectional view in FIG. 2, the pins 40 and 42 fit relatively snugly within the receptacle openings 36 and 38. Accordingly, any jarring, movement or other force exerted on the cable 12 will not be transmitted to the connection mechanism or the plug or outlet. Therefore, the connection mechanism 20, including the male portion and female portion, will be spared from forces thereon.

In one application of the invention, a 130 foot heavy-duty cable was attached between a pipeline tapping machine and a remote control panel. The connection at the tapping machine was approximately 30 feet above ground. It has been found that use of the present invention is effective in alleviating the forces that would otherwise be directed to the connector housing, outlet and connection mechanism.

A salient feature of the present invention is that it may be installed along with the connector housing outlet and connection mechanism or, alternatively, may be added to existing plug and outlet arrangements.

Whereas, the present invention has been described in relation to the drawings attached hereto, it should be understood that other and further modifications, apart from those shown or suggested herein, may be made within the spirit and scope of this invention.

What is claimed is:

1. A strain relief device for use with one end of a cable for attaching the cable to a connector member secured to a bulk head, comprising:

a connector housing receiving an end of a cable, the connector housing having an elongated portion receiving the cable at one end thereof and having an integral portion perpendicular thereto at the other end;

a connector portion received by said connector housing perpendicular portion and positioned to removably engage the connector member secured to the bulk head, the connector portion being in communication with said cable through said connector housing elongated portion;

a block secured to the bulk head adjacent to said connector member and having at least one receptacle opening therein; and a pin affixed to an extending perpendicularly from said connector housing elongated portion, the pin being parallel to and spaced from said connector housing integral perpendicular portion, the pin being automatically insertable into said receptacle opening in said block concurrently and with unitary motion with the coupling of said connector portion to said connector member, the engagement of said pin in said block serving to resist the decoupling of said connector portion and connector member when strain is applied to said cable.

2. A strain relief device according to claim 1 including:

a connection mechanism for detachably securing said connector portion to said connector member.

3. A strain relief device as set forth in claim 1 having two said pins parallel to each other and two receptacles in said block for receiving said pins.

4. A strain relief device as set forth in claim 1 wherein said pin is cylindrical.

* * * * *